US005957400A

United States Patent [19]

Brannen

[11] Patent Number: 5,957,400

[45] Date of Patent: Sep. 28, 1999

[54] SELF WINDING HOSE REEL

[76] Inventor: David B. Brannen, 13411 Charloma Dr., Tustin, Calif. 92780

[21] Appl. No.: 09/083,269

[22] Filed: May 22, 1998

[51] Int. Cl.[6] ..... B65H 75/40

[52] U.S. Cl. ..... 242/391; 242/403; 137/355.27

[58] Field of Search ..... 242/391, 391.1, 242/391.2, 391.3, 403, 403.1; 137/355.12, 355.16, 355.26, 355.27

[56] References Cited

U.S. PATENT DOCUMENTS

| | | | |
|---|---|---|---|
| 118,615 | 8/1871 | Justin | 242/391.3 |
| 578,489 | 3/1897 | Kessler | 242/391.2 |
| 1,545,546 | 7/1925 | Brittin | 242/391.2 |
| 1,812,065 | 6/1931 | Svade | 242/391.2 |
| 1,850,676 | 3/1932 | Kieneman | 242/391.2 |
| 5,425,391 | 6/1995 | Tisbo et al. | 137/355.27 |
| 5,462,298 | 10/1995 | Bodine | 242/403 |

FOREIGN PATENT DOCUMENTS

| | | | |
|---|---|---|---|
| 1063672 | 8/1959 | Germany | 242/391 |

*Primary Examiner*—John M. Jillions
*Attorney, Agent, or Firm*—G. Donald Weber, Jr.

[57] ABSTRACT

A self winding reel for an elongated, flexible component such as a hose, a cable or other similar component. The reel is operated to wind the hose thereon when pushed forward and to unwind the hose therefrom when the reel is pulled backward, without any additional handling of the hose.

19 Claims, 4 Drawing Sheets

SELF WINDING HOSE REEL

PRIOR ART STATEMENT

1. Field of the Invention

This invention is directed to a hose reel, in general, and to a hose reel which winds or unwinds hose thereon when the reel is moved forward or backward, without special handling of the hose, in particular.

2. Background

There are many instances when it is desirable to wind an elongated item such as a hose, a cable or the like into a compact arrangement. This can be accomplished by merely coiling the item loosely on the support surface, into a tub container, or over support brackets. However, it is also desirable to have the item (e.g. a garden hose) wound onto a reel for ease in transporting the hose which can be heavy or cumbersome to move.

Hose reels are known in the art. In these devices, a reel is rotatably supported in a structure which may include wheels for easy movement thereof. However, these known reels, typically, require a crank handle or the like to turn the reel in order to wind the hose thereon (or to remove the hose therefrom). This apparatus has the drawback that the heavy hose must be pulled or dragged for its entire length as it is wound onto the reel. In come cases, the hose, per se, can be quite heavy and, therefore, difficult to handle. In addition, the hose may contain water therein whereupon the hose is extremely heavy and difficult to manipulate as it is wound onto the reel. Likewise, if the hose goes around a corner of a building, a tree or some other obstacle, it must be dragged and repositioned before winding can begin.

Another drawback of existing reels, except for wall mounted reels, is they tend to tip over when the winding crank is turned. A projection is usually provided at the base of the reel on which the user places a foot while turning the crank. This is both awkward and irritating.

Again, many reels, except for wall mounted reels, have a tool tray for storing small garden tools such as trowels and clippers. However, because the reel is connected to a faucet by a short length of hose, some models require a quick disconnect feature to avoid unscrewing the fitting at the faucet.

Finally, in some instances, these known hose reels include an integral hose connection which is connected between the hose bib and the end of the actual hose. This connection, which involves a rotating seal, tends to leak which is quite annoying and/or wasteful when the hose is in use.

DESCRIPTION OF A PREFERRED EMBODIMENT

Figure 1:
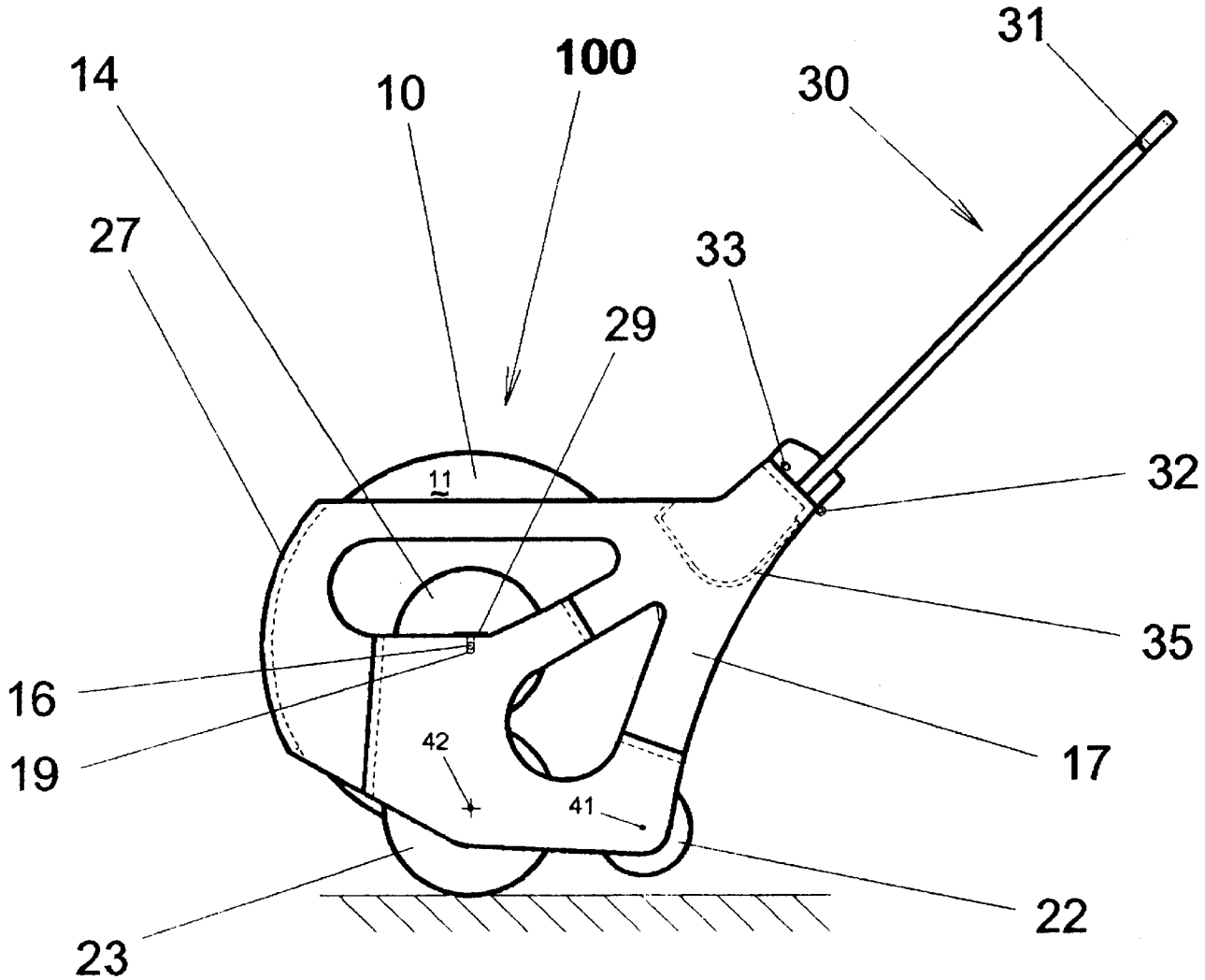
FIG. 1 is a side elevation view of one embodiment of a preferred embodiment of the instant invention.

Referring concurrently to FIGS. 1, 2, 3 and 4, there are shown a side elevation view, a partially broken away front elevation view, a partially broken away side elevation and a partially broken away isometric view, respectively, of one embodiment of the reel apparatus 100 of the instant invention. The apparatus 100 includes reel 10 which, in this embodiment, includes substantially planar side disks 11 and 12 on opposite sides thereof. The disks are joined together (and spaced apart) in a substantially parallel arrangement by a plurality of reel spokes 13. In this embodiment, the spokes 13 are spaced equidistant around the reel. The spokes 13 are disposed inwardly relative to the perimeter of the disks in order to establish a "trough" to receive the item to be wound onto the reel. Of course, it is contemplated that the spokes can be replaced by a functionally equivalent surface or the like. While not so limited, the spokes 13 can be arranged in a cylindrical configuration.

Cylinders 14 and 15 are attached to the outer surfaces of disks 11 and 12, respectively. The cylinders 14 and 15 (also referred to as drums) are formed coaxially with the respective disks. It is contemplated that the associated disks and drums can be integrally formed. A common shaft 16 forms the central axis for the drums and disks.

The apparatus 100 includes a support frame formed by sides 17 and 18 which are, typically, substantially parallel side panels. The side panels 17 and 18 include slots or apertures 19 and 20, respectively, which are located in the central region of the panels thereof. These slots are arrayed to receive and retain the reel shaft 16. In particular, the reel shaft 16 projects into and is supported in the vertical slots 19, 20 in each side of the frame. Appropriate retainers, e.g. retainer 29 in FIG. 1, are provided to retain the ends of shaft 16 in the respective slots 19 and 20. These can be integral with the sides 17 and 18, rather than being separate parts. For example, axle apertures or holes 20A can be utilized (see FIG. 4). A slot provides tolerance so that the weight of the reel holds the drums in contact with the front wheels 23 and 24. Thus, the reel 10 is mounted between the side panels 11 and 18.

Rear wheels 21 and 22 are rotatably mounted to the rear-bottom portion of the side panels 17 and 18, respectively, by suitable bearings, axles or the like. Typically, the rear wheels 21 and 22 are mounted on a common shaft 41 which also provides added strength and stiffness to the bifurcated frame. The rear wheels also assist in moving the apparatus 100 over curbs or other obstacles. Conversely, front wheels 23 and 24 are rotatably mounted, typically on stub shafts 42 and 43, at the center-bottom portion of the side panels 17 and 18 using appropriate bearings in the wheel hubs 25 and 26.

Figure 2:
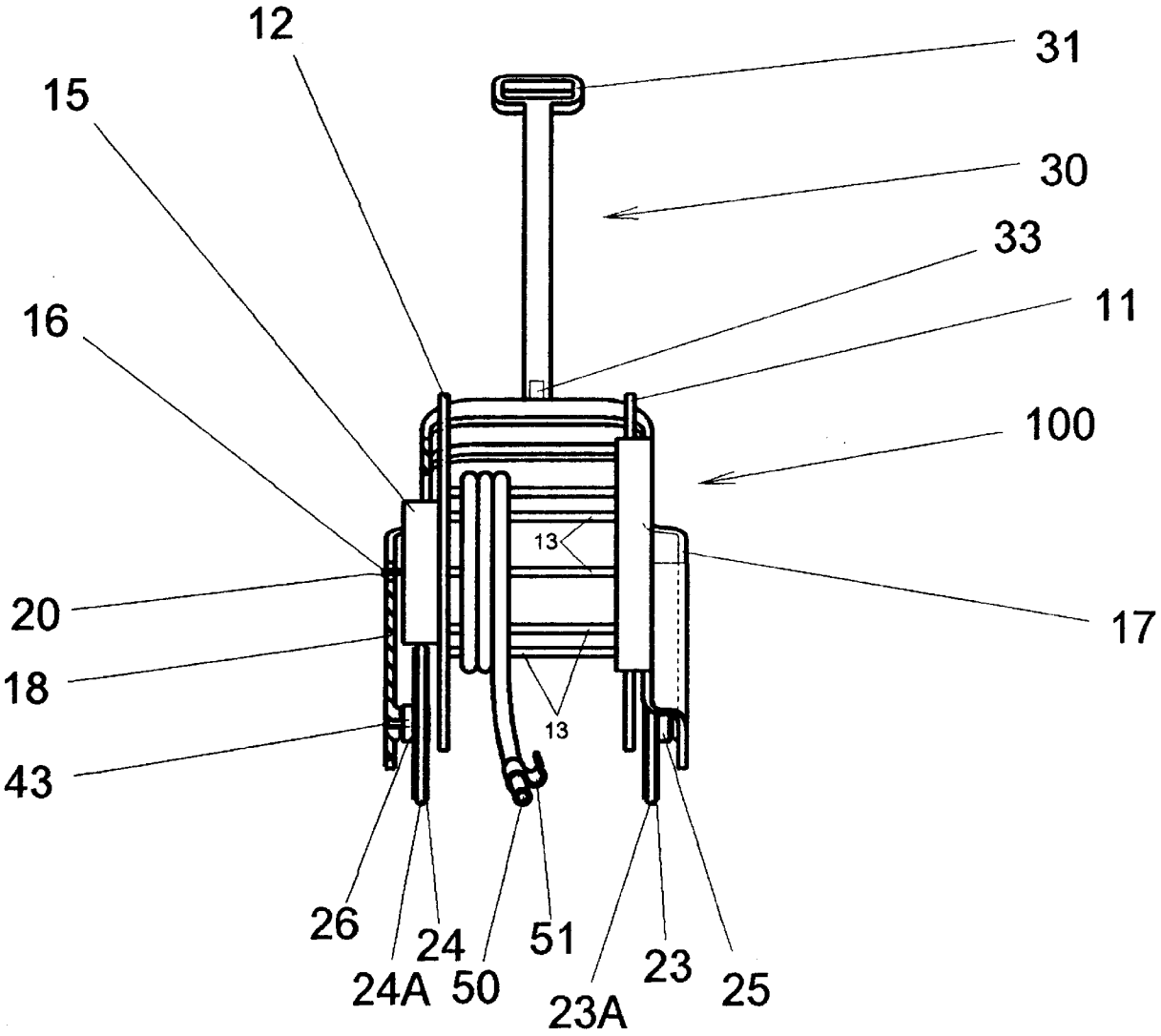
FIG. 2 is a partially broken away, front elevation view of a preferred embodiment of the instant invention.

It will be observed that the diameters of drums 14 and 15 and the diameters of front wheels 23 and 24 are selected so that at least one front wheel engages and drives the associated drum (and the attached reel) as shown in FIG. 2. In a preferred embodiment, the front wheels 23 and 24 may include a rubber or similar surface 23A and 24A to better engage the surface of the associated drum. Of course, the drums 14 and 15 may be surfaced in this manner alone or in combination with the front wheels.

Figure 3:
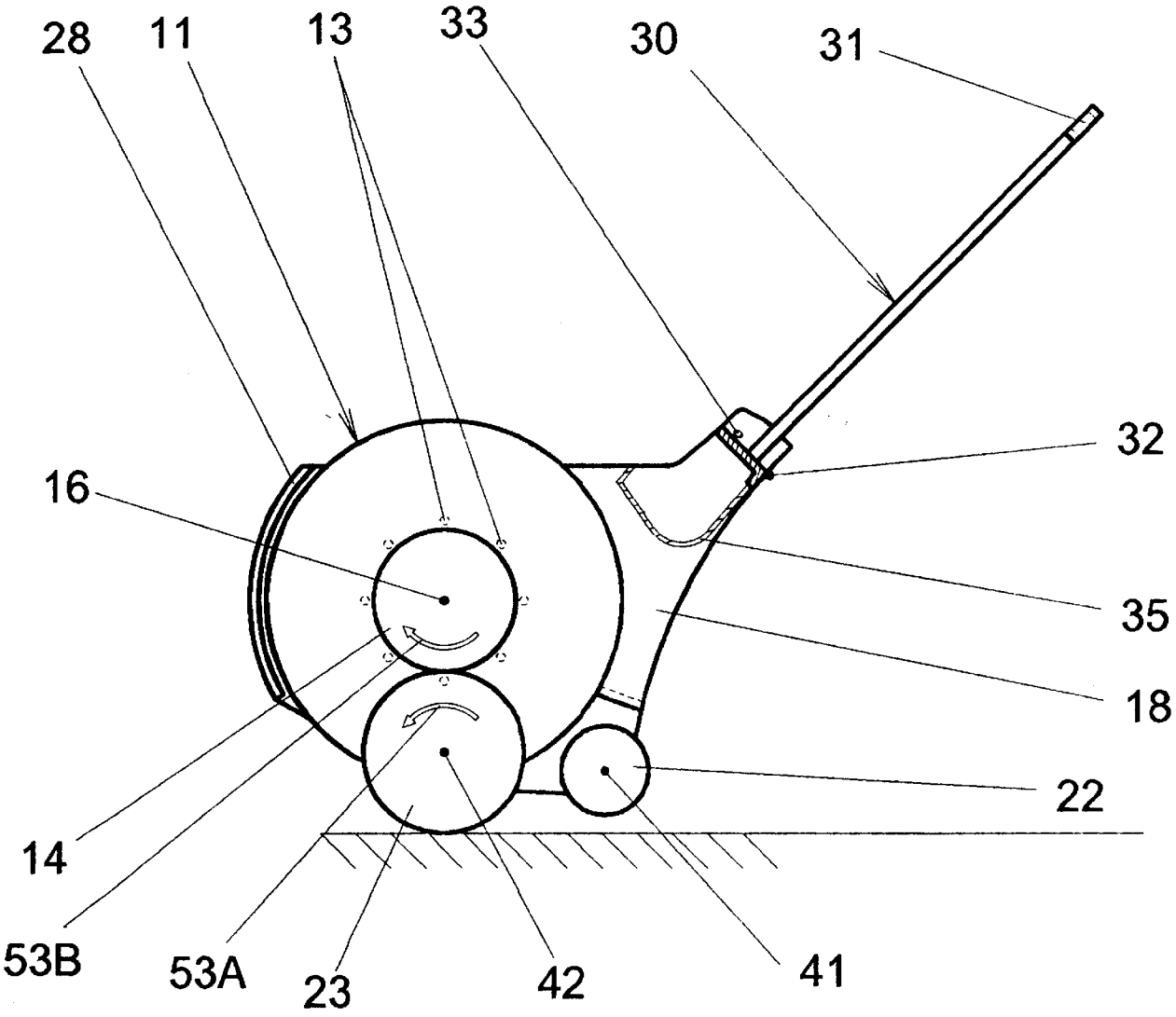
FIG. 3 is a partially broken away side elevation view of the embodiment shown in FIG. 1.
Figure 4:
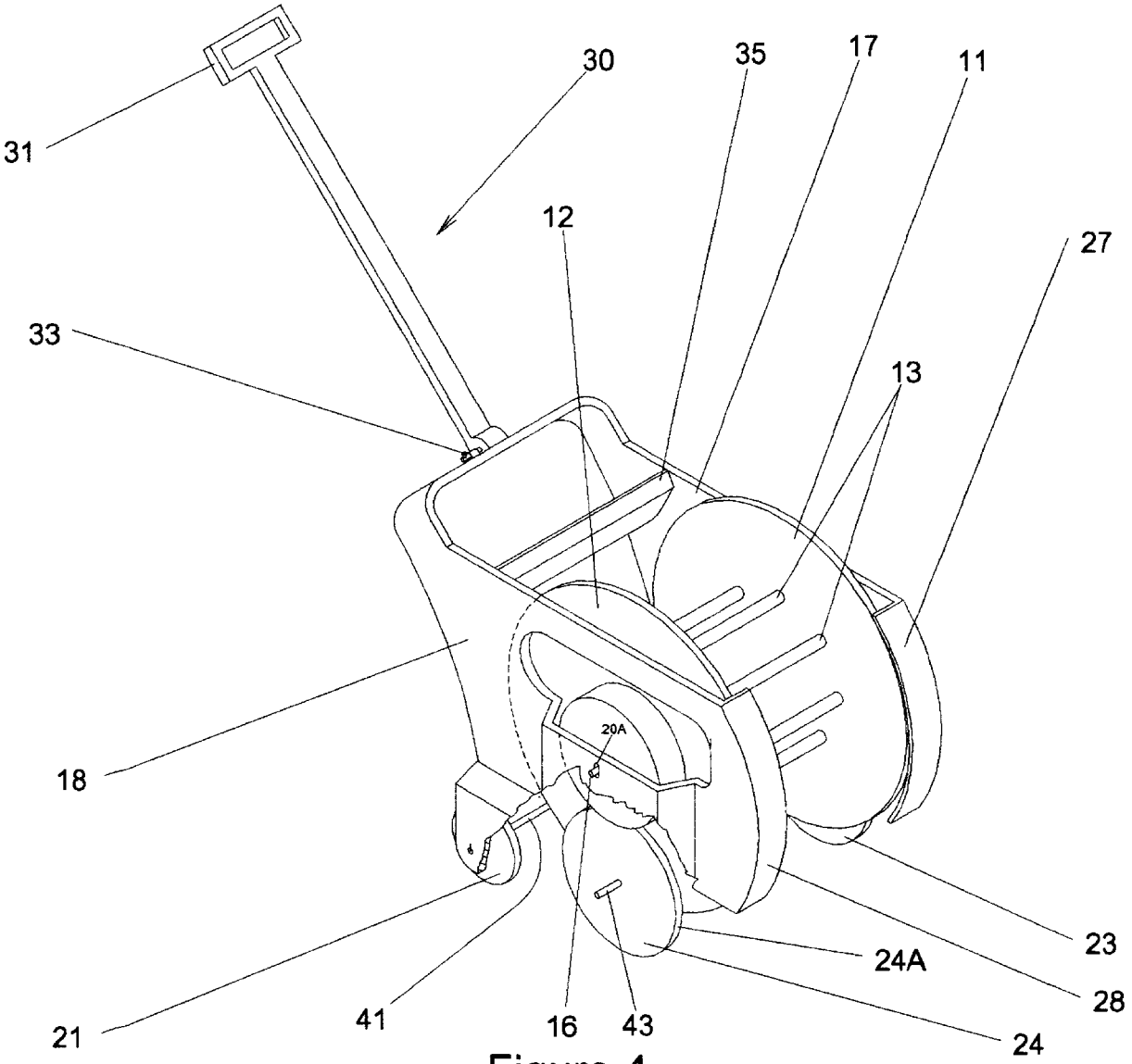
FIG. 4 is an isometric view with the frame partially broken away.

As seen best in FIGS. 3 and 4, fenders 27 and 28 extend inwardly from the side panel 17 toward the center of the apparatus 100. (The fender 27 is shown in dashed outline in FIG. 1.) The fenders 27 and 28 direct the hose 50 (see FIG. 2) onto the reel 11 during a windup process.

The fenders 27 and 28 on the front of the device do not contact the reel 10, but they extend inboard slightly past the inner surfaces of the reel ends defined by disks 11 and 12. The fenders serve to guide the hose onto the reel 10 during the winding process. Also, the fenders tend to provide steering capability for the apparatus.

The apparatus 100 includes a push/pull handle 30 which is joined to the frame at a common junction between the side panels 17 and 18. The handle 30 includes a hand grip 31 in a preferred embodiment. Also, it is contemplated that the handle 30 may be hingedly attached to the frame by hinge 32 so that the handle can be folded for storage if so desired. A suitable latch 33, for example, a latch pin can be used to lock the handle 30 in position when the apparatus 100 is in use.

As best seen in FIG. 3, there is shown a side elevation of the apparatus 100 with the side panel 17 and fender 27 removed for convenience. Components which are similar to those discribed supra bear similar reference numerals.

An optional tool bin 35 (best shown in FIG. 3) is provided at the upper portion of the frame adjacent to the lower end of handle 30 and intermediate the side panels 17 and 18. The tool bin 35 can be used for carrying tools, or any materials which might be necessary and/or desirable for the user of the apparatus 100. Of course, the tool bin 35 can be omitted and replaced by any suitable and desirable structural member to impart strength to the overall apparatus.

With side panel 17 removed, the tangential interaction between front wheel 23 and drum 14 is clear. Also, it is shown that rear wheel 22 does not interact with drum 14 or reel 10, per se. The rear wheels are used for rolling support while pulling the apparatus 100 when unwinding the hose on reel 10, or for lifting the front wheels over obstacles when winding, as described infra.

Likewise, with the panel 17 and fender 27 removed, the position of fender 28 and the optional tool bin 35 are clearly depicted.

In operation, a user simply walks along, pushing the apparatus 100 by handle 30 and the handle grip 31. When the apparatus 100 is pushed forward, the front wheels rotate as suggested by arrow 53A. Thus, the drums 14, 15, driven by frictional contact with the front wheels 23, 24, turn in the direction shown by the arrow 53B in FIG. 3. The drums are joined to the reel 10 which is rotated therewith. This causes the hose 50, one end of which was inserted between the spokes 13, to wind up on the reel.

In a preferred embodiment, the reel 10 rotates fast enough so that the hose 50 is pulled backward at a slightly faster velocity than the reel moves forward. This action is achieved when the outer diameter of the reel as determined by the outer surface on the reel spokes 13 is slightly larger than the diameter of drums 14 and 15. This action produces a slight tension in the hose so that the hose 50 winds up reasonably tightly on the reel 10. Typically, the other end of the hose is connected to a water faucet. When the hose becomes taut during the windup operation, slippage takes place between the drums 14 and 15 and the front wheels 23 and 24. As the hose is wound up, the diameter over the coils keeps increasing. This causes the slippage to increase, although the frictional torque on the reel stays constant. Thus, the wind-up process functions properly when wind-up has just begun, and also when the reel is full. (The front wheels are like idlers in a gear train. The diameter thereof does not affect the speed of the reel, but serves only to elevate the reel to an appropriate distance above the ground.)

The rear wheels 22 are used while unwinding the hose 50 from the reel 10. That is, the operater merely lowers the handle 30 so that the front wheels are off the ground and pulls the hose reel apparatus 100 which rolls on rear wheels 21 and 22. The reel 10 rotates in a free wheeling manner whereby the hose unwinds freely. Conversely, while winding the hose 50 onto the reel 10, the rear wheels can be used to lift the front wheels over curbs or other obstacles.

It is contemplated that if more friction is required, the front wheels can be constructed to ride in V-shaped grooves in the drums. The resolution of forces will increase the frictional torque. Of course, other ways of increasing the friction may be suggested to those skilled in the art within the scope of this invention.

In normal usage, the free end of the hose will be in the center of the reel after winding. The entire hose must be unwound to make the end accessible. Since winding or unwinding is as easy as walking across the lawn, this is not much of a problem. However, if a user needs only a small fraction of the hose, an alternative method of winding the hose can be utilized. For example, the hose is laid on the ground in a long, narrow loop. A suitable clip 51 is used to fasten the free end to a point on the hose near the faucet. The end of the loop, i.e. a location intermediate the ends of the hose, is then inserted into a space between the spokes 13 of the reel 10. Thus, both sides of the loop or the doubled-up hose are wound up at the same time. The free end of the hose is then immediately accessible.

The clip 51 noted above can be designed in many configurations such as S-shaped, E-shaped or H-shaped, or the like. If it is desired to disconnect the hose 50 from the faucet and move the reel to a different location, the spring clip 51 can be used to secure the dangling hose end.

It is contemplated that the instant walk-along hose reel could be modified to be used in the conventional mode with a hand crank, if desired.

Thus, there is shown and described a unique design and concept of self winding hose reel. While this description is directed to a particular embodiment, it is understood that those skilled in the art may conceive modifications and/or variations to the specific embodiments shown and described herein. Any such modifications or variations which fall within the purview of this description are intended to be included therein as well. It is understood that the description herein is intended to be illustrative only and is not intended to be limitative. Rather, the scope of the invention described herein is limited only by the claims appended hereto.

I claim:

1. A self winding device comprising, a support frame, a storage device rotatably mounted in said support frame, first roller means mounted in said support frame, said first roller means operative to selectively support and transport said frame, and second roller means mounted in said support frame, said second roller means operative to selectively support and transport said support frame, said second roller means engaged in a driving relationship to said storage device and operative to drive said storage device in a first rotational direction when only said second roller means is supporting and transporting said support frame, said second roller means and said storage device are free to rotate in a second rotational direction when only said first roller means is supporting and transporting said support frame.

2. The device recited in claim 1 wherein, each of said first and second roller means comprise wheels.

3. The device recited in claim 1 wherein, said storage device includes a pair of end disks.

4. The device recited in claim 3 wherein, said storage device includes a generally cylindrical support surface intermediate said pair of end disks.

5. The device recited in claim 4 wherein, said support surface is formed by a plurality of spokes disposed intermediate said pair of end disks.

6. The device recited in claim 3 wherein, said storage device includes at least one drive cylinder which is driven by said second roller means.

7. The device recited in claim 6 wherein, said drive cylinder is mounted on at least one of said pair of end disks.

8. The device recited in claim 6 wherein, said support frame includes side panels for supporting and enclosing said storage device and said drive cylinder thereon.

9. The device recited in claim 1 including, handle means connected to said support frame.

10. The device recited in claim 9 wherein, said handle means is hingedly connected to said support frame so that said handle means can be selectively folded against said support frame.

11. The device recited in claim 1 including, axle means for mounting said storage device in said support frame.

12. The device recited in claim 1 including, fender means formed on said support frame adjacent to said storage device.

13. The device recited in claim 1 including, a carrier device mounted in said support frame to carry objects therein.

14. The device recited in claim 1 wherein, said driving relationship is a tangential friction engagement between said second roller means and said storage device.

15. The device in claim 14 wherein, said tangential friction engagement selectively permits slippage between said second roller means and said storage device.

16. A winding reel apparatus comprising, a support frame, a storage reel rotatably mounted in said support frame, axle means passing through said storage reel for mounting said storage reel for forward and reverse rotation thereof in said support frame, first roller means mounted in said support frame and adapted to roll on a surface, second roller means mounted in said support frame and adapted to roll on the surface independent of said first roller means and in driving relationship to said storage reel, a drive mechanism mounted on said storage reel to be engaged and rotatably driven in a forward rotatable direction by said second roller means only when said second roller means rolls on the surface, and handle means connected to said support frame to determine the position thereof and which of said first and second roller means is in contact with and rolls on the surface.

17. The device recited in claim 16 wherein, said second roller means is selectively inoperative to drive said storage reel when said first roller means is rendered operative to move said device by appropriate positioning of said handle means.

18. The device recited in claim 16 including, fender means formed on said support frame adjacent to said storage reel for controlling the storage of a component on said storage reel during the rotation thereof.

19. The device recited in claim 16 wherein, said support frame includes side panels for supporting said axle means and enclosing said storage reel and said drive mechanism thereon.

* * * * *